US006565401B1

(12) United States Patent
Sugano et al.

(10) Patent No.: US 6,565,401 B1
(45) Date of Patent: May 20, 2003

(54) CATHODE RAY TUBE MANUFACTURING METHOD AND CATHODE RAY TUBE MANUFACTURING SYSTEM

(75) Inventors: Takeshi Sugano, Tokyo (JP); Etsushi Adachi, Tokyo (JP); Chikayuki Nakamura, Tokyo (JP); Wataru Imanishi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 397 days.

(21) Appl. No.: 09/584,351

(22) Filed: Jun. 1, 2000

(30) Foreign Application Priority Data

Jul. 21, 1999 (JP) ..... 11-205976

(51) Int. Cl.[7] ..... H01J 9/38
(52) U.S. Cl. ..... 445/40; 445/41; 445/45
(58) Field of Search ..... 445/40, 41, 45

(56) References Cited

U.S. PATENT DOCUMENTS 2,871,086 A * 1/1959 Korner et al. ..... 445/40
5,766,054 A * 6/1998 Kaihara ..... 445/40
2002/0042240 A1 * 4/2002 Fujimura et al. ..... 445/41

FOREIGN PATENT DOCUMENTS

| | | | |
|---|---|---|---|
| JP | 57067260 | | 4/1982 |
| JP | 58-051443 | * | 3/1983 |
| JP | A63181237 | | 7/1988 |
| JP | A63248034 | | 10/1988 |
| JP | 5028907 | | 2/1993 |
| KR | 1019970008297 | | 2/1997 |
| KR | 1019970051680 | | 7/1997 |

* cited by examiner

*Primary Examiner*—Kenneth J. Ramsey
(74) *Attorney, Agent, or Firm*—Birch, Stewart, Kolasch & Birch, LLP.

(57) ABSTRACT

A getter film is formed on an inner surface of a funnel portion of a cathode ray tube, and an inner conductor of the cathode ray tube is heated by a heating unit. According to this heating, the gas which is physically adsorbed by the inner conductor of the cathode ray tube other than the getter film is discharged and then chemically adsorbed again by the getter film, whereby a degree of vacuum in the cathode ray tube can be increased.

8 Claims, 11 Drawing Sheets

20
CRT CARRYING DIRECTION
1
29
30

30

CATHODE RAY TUBE MANUFACTURING METHOD AND CATHODE RAY TUBE MANUFACTURING SYSTEM

BACKGROUND OF THE INVENTION

1. Field of the Invention

The present invention relates to a cathode ray tube manufacturing method and a cathode ray tube manufacturing system which can increase a degree of vacuum in a cathode ray tube after getter flash.

2. Description of the Related Art

In the related art including Japanese Patent Unexamined Publication No. Sho. 57-67260, normally an inside of the cathode ray tube can be kept in a vacuum by sealing a tip tube, which is attached to an electron gun in the cathode ray tube, in an exhaust furnace to melt and seal it.

Then, in order to form a getter film which chemically adsorbs gas molecules of a residual gas in the cathode ray tube to increase a degree of vacuum in the cathode ray tube, the getter flash is carried out by high-frequency heating the getter in the cathode ray tube to vapor it onto an inner surface of the cathode ray tube.

Then, thermal decomposition of a cathode is performed, and then ageing is carried out to activate the oxide cathode of the electron gun at a point of time when the gas molecules of the residual gas is reduced.

In addition to the above, as the technology for improving the degree of vacuum in the cathode ray tube, in Japanese Patent Unexamined Publication No. Sho. 63-248034, a heater of the electron gun is heated in order to decompose the gas molecules of the residual gas, which still remain in the cathode ray tube, into carbon dioxide and moisture, which the getter film is ready to chemically adsorb. Also, in Japanese Patent Unexamined Publication No. Hei. 5-28907, as shown in FIG. 11, as a method of activating the cathode, gun heating in which high-frequency dielectric heating is applied to parts of the electron gun is carried out prior to the ageing step.

In the cathode ray tube manufacturing method in the related art, when the getter is fitted to the funnel, t he getter is oxidized and also adsorbs a quantity of gas because the cathode ray tube is heated in the frit sealing step. Then, because such gas is outgassed at the time of getter flash immediately before the getter is vapored, the gas is readsorbed by materials in the cathode ray tube and then discharged in the ageing step or in operation to exert a harmful influence upon the cathode. As a result, the electron emmitting characteristic of the cathode is lowered. In other words, the emission life characteristic of the cathode ray tube is degraded.

Also, the gas which is discharged before the getter flash is physically adsorbed by inner structures of the cathode ray tube by virtue of the van der Waals force, etc., and such gas cannot be adsorbed by the getter film after the getter flash to still remain in the inner structures of the cathode ray tube. Therefore, the gas which has been physically adsorbed is discharged gradually in the cathode ray tube according to the temperature rise caused in the ageing step or in operation of the cathode ray tube to exert the harmful influence upon the cathode. Thus, the emission life characteristic of the cathode ray tube is also degraded.

In addition, if merely the thermal decomposition of the cathode is carried out by heating an electron gun mounting structure to 200° C. or more after the getter flash, the temperature rise of the inner structures of the cathode ray tube is small and thus the outgas which has been physically adsorbed is small. In particular, since the gas which has been physically adsorbed by an inner coating graphite acting as an internal conductor on an inner surface of the funnel portion cannot be discharged during manufacturing steps of the cathode ray tube, such heating of the electron gun mounting structure can make only a small contribution to improvement of the emission life characteristic.

SUMMARY OF THE INVENTION

The present invention has been made to overcome the above subjects, and it is a first object of the present invention to provide a cathode ray tube manufacturing method which is capable of outgassing a gas, which has been physically adsorbed by inner structures of a cathode ray tube after getter flash, into an inside of the cathode ray tube during manufacturing steps of the cathode ray tube and then causing the getter film to chemically adsorb the gas not to be outgassed into the inside of the cathode ray tube in the ageing step or in operation of the cathode ray tube.

Also, it is a second object of the present invention to provide a cathode ray tube manufacturing system which is capable of discharging the gas, which has been physically adsorbed by the inner structures of the cathode ray tube, into the inside of the cathode ray tube and then causing the getter film to chemically adsorb the gas.

In order to achieve the above first object, according to a first aspect of the invention, there is provided a cathode ray tube manufacturing method comprising: an exhaust step of removing an air and a residual gas in an inside of a cathode ray tube; a getter flash step of removing the residual gas; a heating step for heating a funnel portion of the cathode ray tube; and an ageing step for activating the cathode.

In order to achieve the above second object, according to a second aspect of the invention, there is provided a cathode ray tube manufacturing system comprising: a moving board for moving a cathode ray tube in parallel with a set of surfaces of a funnel portion of the cathode ray tube while fixing the cathode ray tube; infrared seating means arranged in parallel with a carrying direction of the moving board and at a level higher than a lower end of the moving board along the funnel portion of the cathode ray tube; and a supporting table for supporting the moving board and the infrared heating means, wherein the moving board has an auxiliary mirror surface which reflects an infrared ray to the funnel portion in a carrying direction side.

According to a third aspect of the invention, there is provided a cathode ray tube manufacturing system comprising: a moving board for moving a cathode ray tube while fixing the cathode ray tube; infrared heating means arranged in parallel with a carrying direction of the moving board along a funnel portion; and a cage for supporting the infrared heating means to cover the cathode ray tube.

BRIEF DESCRIPTION OF THE DRAWINGS

FIG. 6(*b*) is a front view showing the cathode ray tube manufacturing method according to the embodiment 7 of the present invention.

FIG. 6(*c*) is a side view showing the cathode ray tube manufacturing method according to the embodiment 7 of the present invention.

FIG. 9(*b*) is a view showing an auxiliary mirror surface in the cathode ray tube manufacturing system.

FIG. 10(*b*) is a view showing an auxiliary mirror surface in the cathode ray tube manufacturing system.

DETAILED DESCRIPTION OF THE PREFERRED EMBODIMENTS

Embodiment 1

Figure 1:
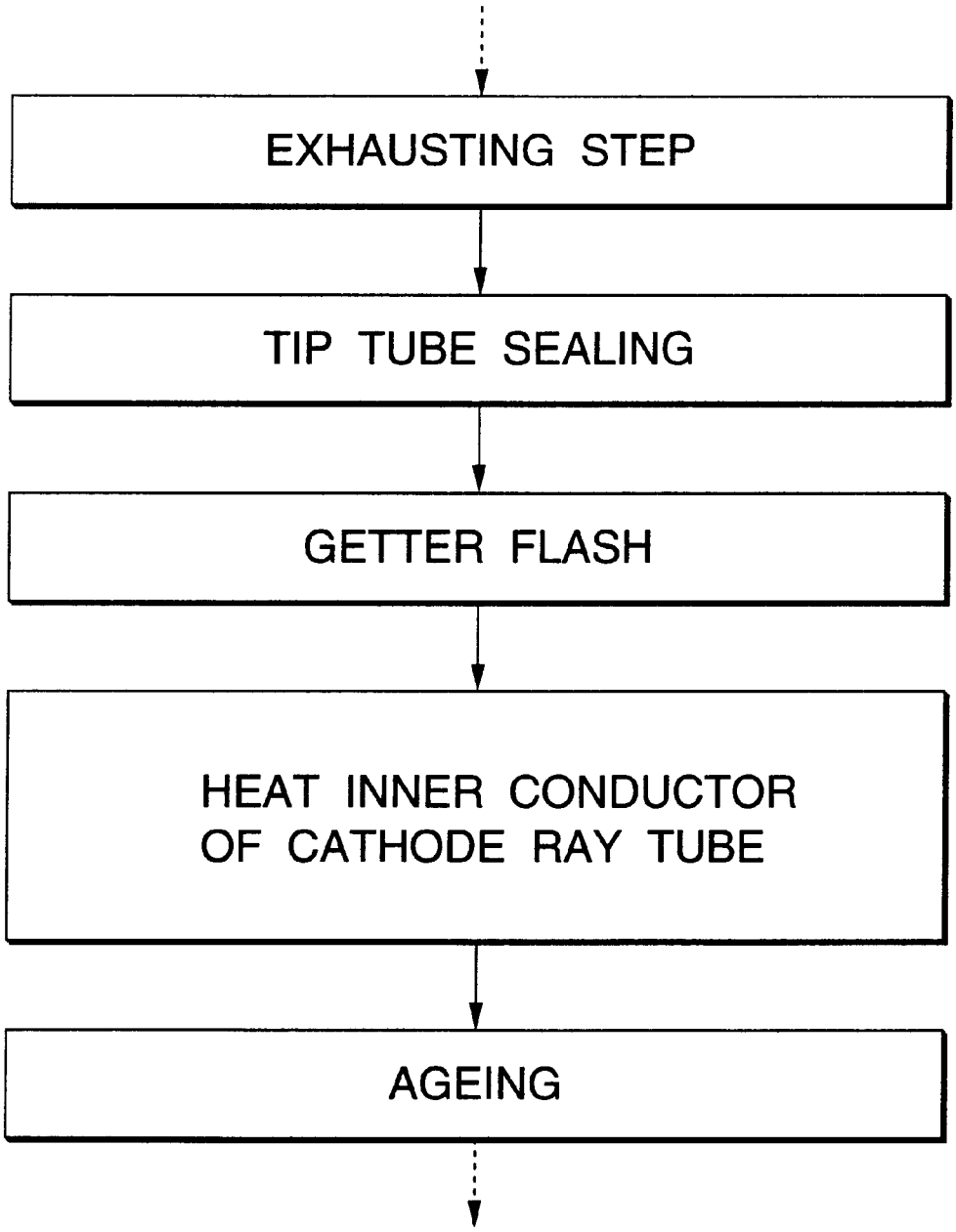
FIG. 1 is a chart showing steps of a cathode ray tube manufacturing method according to an embodiment 1 of the present invention.

FIG. 1 is a chart showing steps of a cathode ray tube manufacturing method according to an embodiment 1 of the present invention. The cathode ray tube which is subjected to predetermined steps is heated and exhausted, then the cathode ray tube is sealed by a tip tube, then getter flash which vapors a getter by heating a getter ring by virtue of high-frequency heating is applied, then a getter film is formed on an inner surface of a funnel portion of the cathode ray tube, and then an inner conductor of the funnel portion of the cathode ray tube is heated by a heating unit. The gas which has been physically adsorbed by inner conductors of the cathode ray tube other than the getter film is discharged by this heating, and then a degree of vacuum in the cathode ray tube is increased by causing the getter film to chemically readsorb the gas.

Then, the cathode is activated by the ageing step in which a predetermined voltage is applied to an electron gun.

Figure 2:
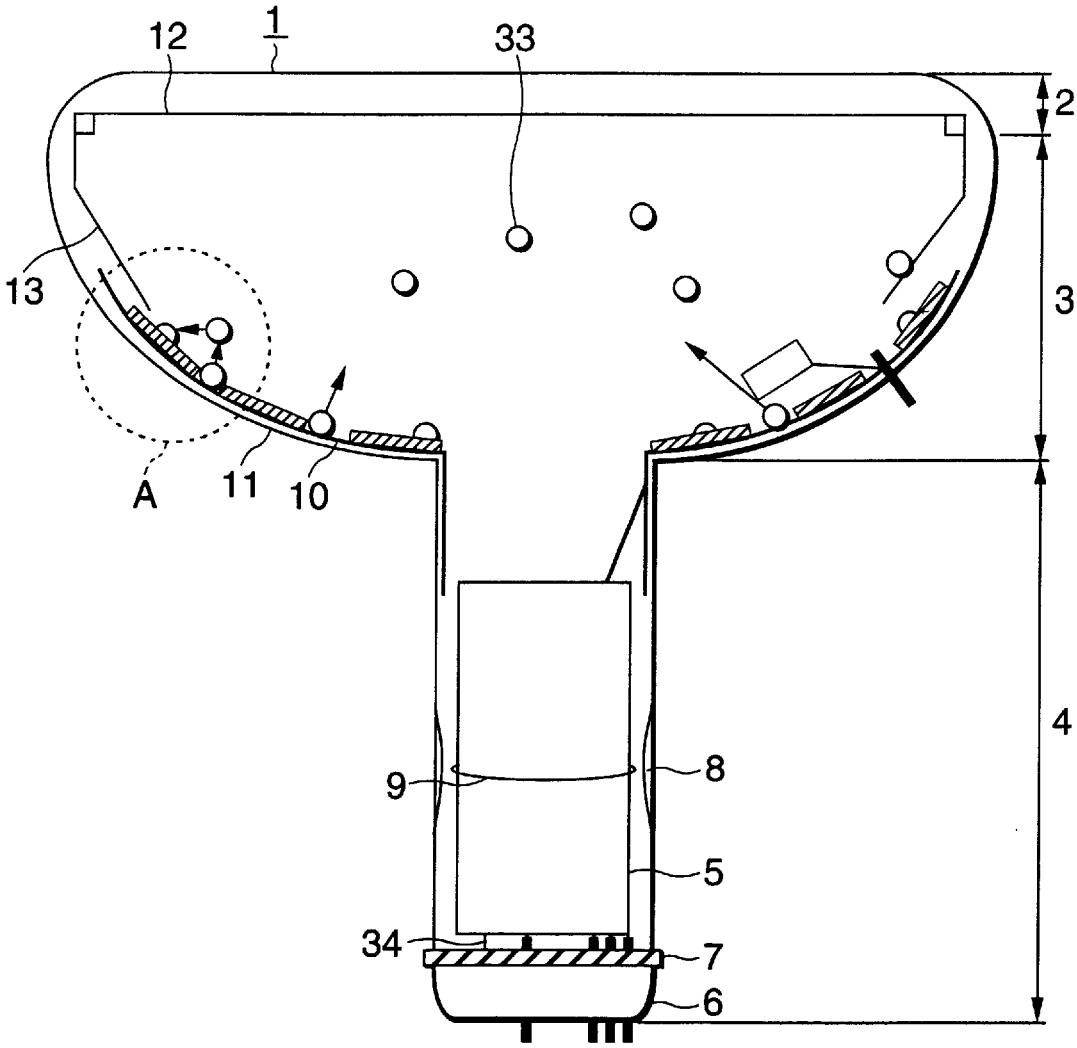
FIG. 2 is a schematic view showing an inner state of the cathode ray tube in the embodiment 1 of the present invention.

FIG. 2 is a schematic view showing an inner state of the cathode ray tube in the embodiment 1 of the present invention. In FIG. 2, 1 denotes a cathode ray tube; 2, a panel portion of the cathode ray tube 1; 3, a funnel portion of the cathode ray tube 1; 4, a neck portion of the cathode ray tube 1; 5, an electron gun installed in the neck portion 4; 6, a base for holding conductive terminals for the electron gun 5 not to bend them; 7, a base silicon for isolating terminals of the electron gun 5 and fixing the base 6; 8, an arc shield; 9, an arc shielding line to form the arc shield 8; 10, an inner coating graphite formed on the inside of the funnel portion 3 as an inner conductor; 11, a getter film which is vapored by the getter flash; 12, a grid used for color selection; 13, a metal plate shield acting as an inner magnetic shield for preventing the magnetism applied from the outside; 33, gas molecules in the cathode ray tube 1 after the exhausting step; and 34, a tip tube consisting of a glass tube which is provided to the electron gun 5 to exhaust the inside of the cathode ray tube 1.

In such cathode ray tube 1, the gas molecules 33 are floated in the inside of the cathode ray tube 1 after the getter flash process. Also, in the inside of the cathode ray tube 1, there are the gas molecules 33 which are chemically adsorbed by the getter film 11 and the gas molecules 33 which are physically adsorbed by the inner coating graphite 10, the grid 12, the metal plate shield 13, etc. other than the getter film 11. In particular, in many cases the gas molecules 33 are physically adsorbed by the inner coating graphite 10.

In the cathode ray tube manufacturing method according to the present invention, the inner conductor of the cathode ray tube 1 is heated in the above condition. Therefore, as depicted schematically in the A portion in FIG. 2, the gas molecules 33 which are physically adsorbed by constituent members other than the getter film 11 are outgassed into the cathode ray tube 1 and then chemically adsorbed by the getter film 11 whose gas adsorbing rate is enhanced by the temperature rise.

Here, the physical adsorption bonds molecules by the van der Waals force and thus is affected by a surface area and a surface shape. In contrast, the chemical absorption bonds molecules by the chemical reaction and thus is affected by the surface area. The physical absorption is shifted from absorption to discharge when the temperature is increased because the increase in a discharging rate and a amount of outgassing are increased rather than the increase in an adsorbing rate and an amount of absorption. In contrast, there is no discharge in the chemical absorption even when the temperature is increased if an energy at that time is lower than the bond energy.

Therefore, according to the heating of the cathode ray tube 1, the gas which is discharged in the ageing step or in operation of the cathode ray tube 1 can be reduced, the emission characteristic of the cathode ray tube 1 can be improved, and reliability of the cathode ray tube 1 can be enhanced.

For example, no difference has been found between the cathode ray tube 1 which is subjected to the heating process after the ageing step and the cathode ray tube 1 which is not subjected to the heating process. However, as the result of the trial that the cathode ray tube 1 is heated at 150° C. for 60 minutes in an electric furnace with blower after the getter flash, a lifetime of the cathode ray tube 1 can be about three times improved rather than the cathode ray tube 1 in the related art.

Embodiment 2

It is set forth in the embodiment 1 that the cathode ray tube 1 is heated by the heating unit, but the inner conductor of the cathode ray tube 1 is heated by an infrared heating unit in the embodiment 2. Since the heating of the cathode ray tube 1 is executed by the infrared heating unit in this manner, the temperature of the inner coating graphite 10, the grid 12, and the metal plate shield 13 can be increased in a short time. Since the inner conductor to which the gas moleculars 33 are physically adsorbed can be directly heated by the infrared ray unlike the heating by a blast of hot air, an electric heater, etc., the gas moleculars which have been physically adsorbed can be outgassed into the inside of the cathode ray tube 1 in a short time, so that a production efficiency of the cathode ray tube 1 can be improved.

According to the examination, an advantage similar to that achieved by the 60-minute heating at 150° C. in the electric furnace with blower can be achieved by 5-minute heating of an infrared lamp used as the infrared heating unit. As a result, considerable reduction of time can be attained.

Embodiment 3

Figure 3:
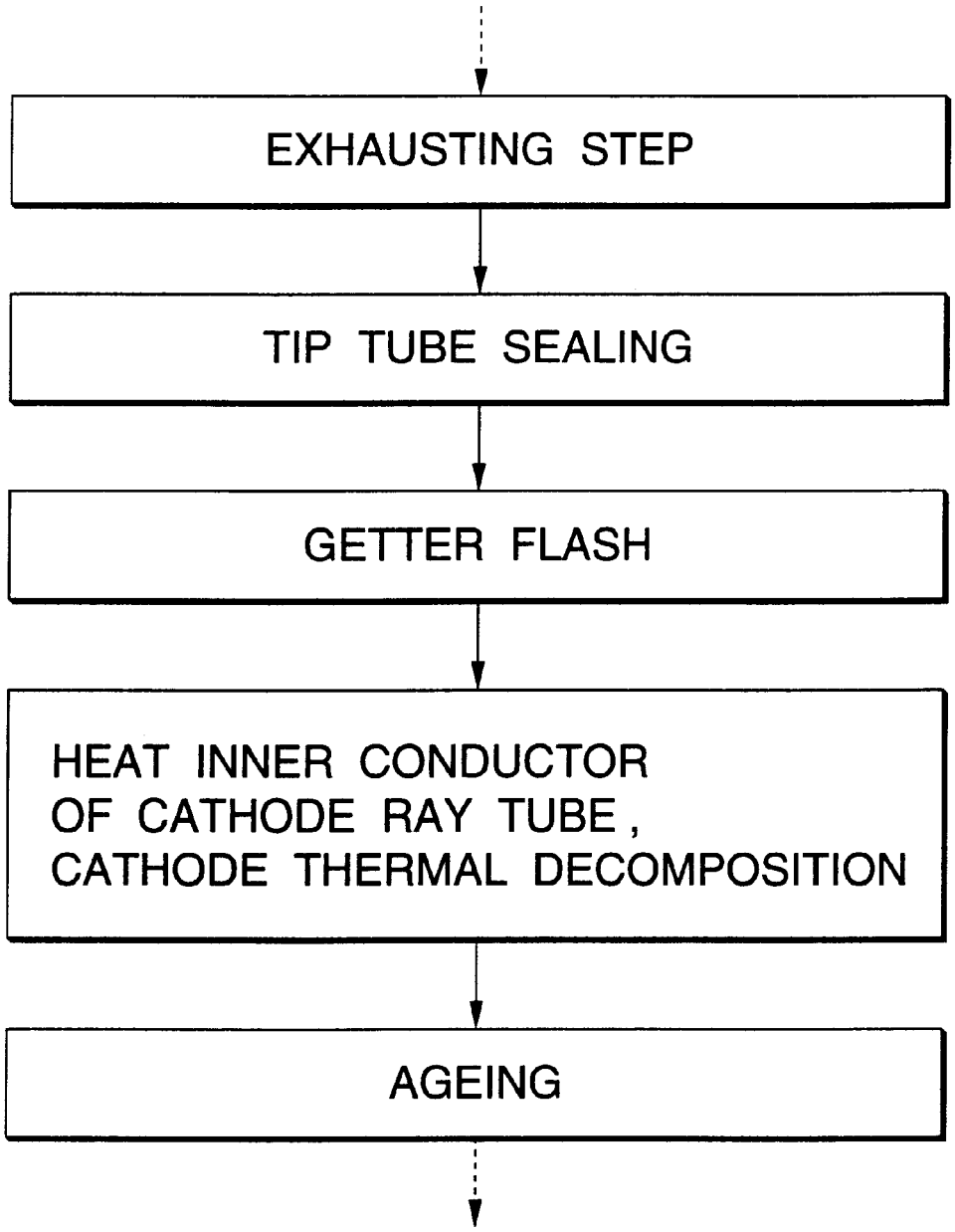
FIG. 3 is a chart showing steps of a cathode ray tube manufacturing method according to an embodiment 3 of the present invention.

FIG. 3 is a chart showing steps of a cathode ray tube manufacturing method according to an embodiment 3 of the present invention. This embodiment 3 has such a feature that there is provided the step of executing thermal decomposition of the cathode while heating the cathode ray tube 1 after such cathode ray tube 1 has been heated in the embodiment 1. Therefore, since the gas which is discharged by the thermal decomposition reaction of the cathode is not physically adsorbed by the inner conductor of the cathode ray tube 1 but chemically adsorbed by the getter film 11, the outgas in the ageing step or in operation can be reduced and thus the emission life characteristic of the cathode ray tube 1 can be improved. When the trial to execute the thermal decomposition of the cathode is applied during the heating of the cathode ray tube 1 after the getter flash, the lifetime of the cathode ray tube 1 can be about two times improved rather than the case where the thermal decomposition of the cathode is performed without the heating of the cathode ray tube 1 after the getter flash. Especially the inner coating graphite 10 having a rough surface can contain a large number of gas molecules 33 which are physically adsorbed, and therefore it is important to heat such inner coating graphite 10.

In addition, the gas molecules can be decomposed into $CO_2$ and $H_2O$, which are ready to be adsorbed by the getter film 11, by heating the electron gun 5 by virtue of the heater. As a result, a degree of vacuum in the inside of the above cathode ray tube 1 can be further increased.

Embodiment 4

Figure 4:
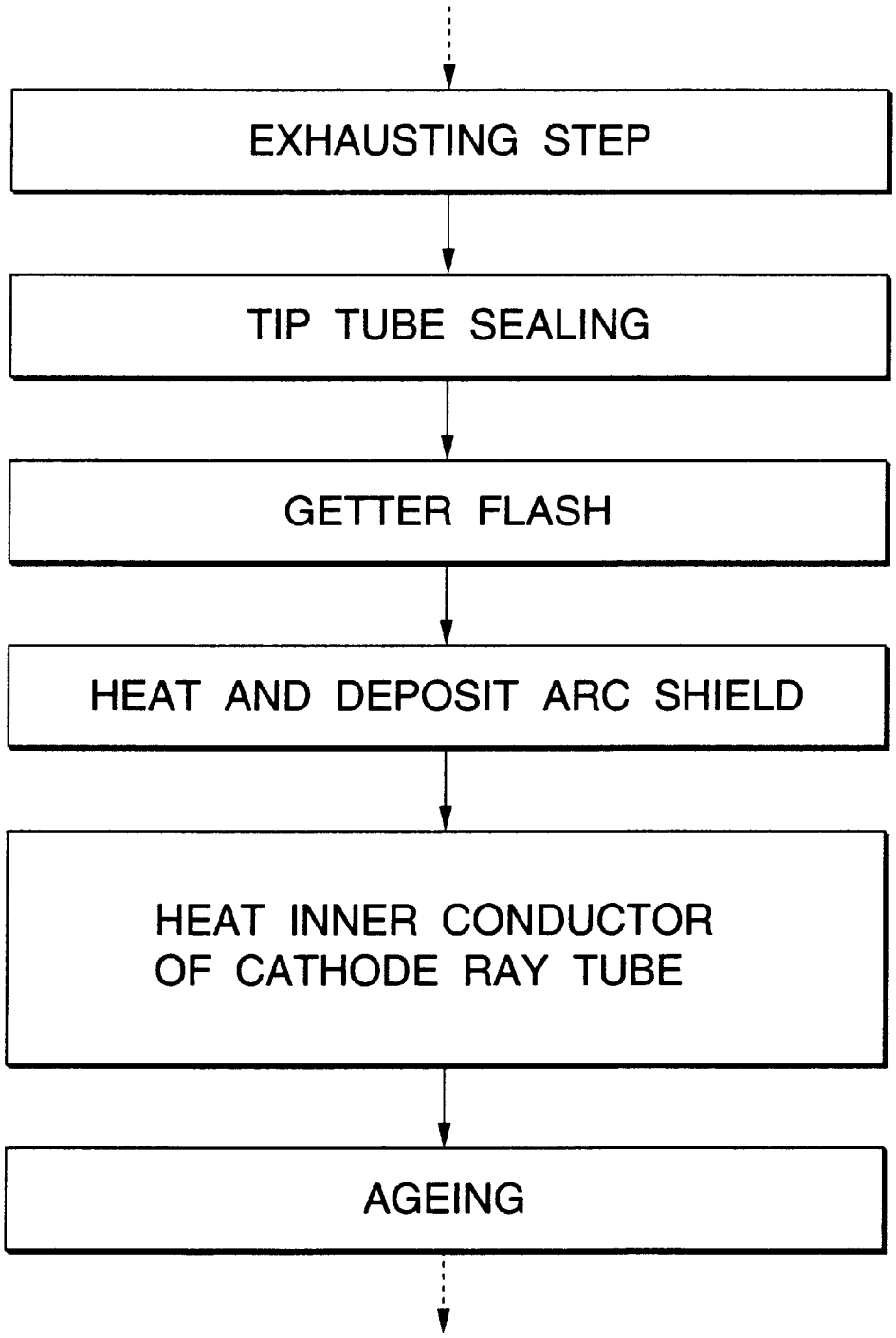
FIG. 4 is a chart showing steps of a cathode ray tube manufacturing method according to an embodiment 4 of the present invention.

FIG. 4 is a chart showing steps of a cathode ray tube manufacturing method according to an embodiment 4 of the present invention. The same steps as those in the embodiment 1 are employed until the getter flash step, then the arc shield 8 is heated and deposited prior to the heating of the inner conductor of the cathode ray tube 1. According to this heating and deposition, the gas molecules 33 which are discharged when the arc shield 8 is formed on an inner surface from the arc shield line 9 to the neck portion 4 can be adsorbed by the getter film at the time when the inner conductor of the cathode ray tube 1 is heated. As a result, the gas being discharged in the ageing step or in operation can be reduced, the damage of the cathode em can be reduced, and the emission lifetime characteristic of the cathode ray tube 1 can be improved.

For example, as the result of the trial which is applied to heat the cathode ray tube 1 after the arc shield 8 has been deposited, the lifetime of the cathode ray tube 1 can be about four times improved rather than the case where no heating is applied to the cathode ray tube 1.

Embodiment 5

As an embodiment 5, the same steps as those in the embodiment 1 are performed until the tip-off step, and then the base 6 and the base silicon 7 are cured prior to the heating of the inner conductor of the cathode ray tube 1. According to this, the step of performing curing of the base silicon 7 and the step of heating the cathode ray tube 1 can be carried out in common, and therefore the cathode ray tube manufacturing steps can be shortened and simplified to thus improve a work efficiency.

Embodiment 6

Figure 5:
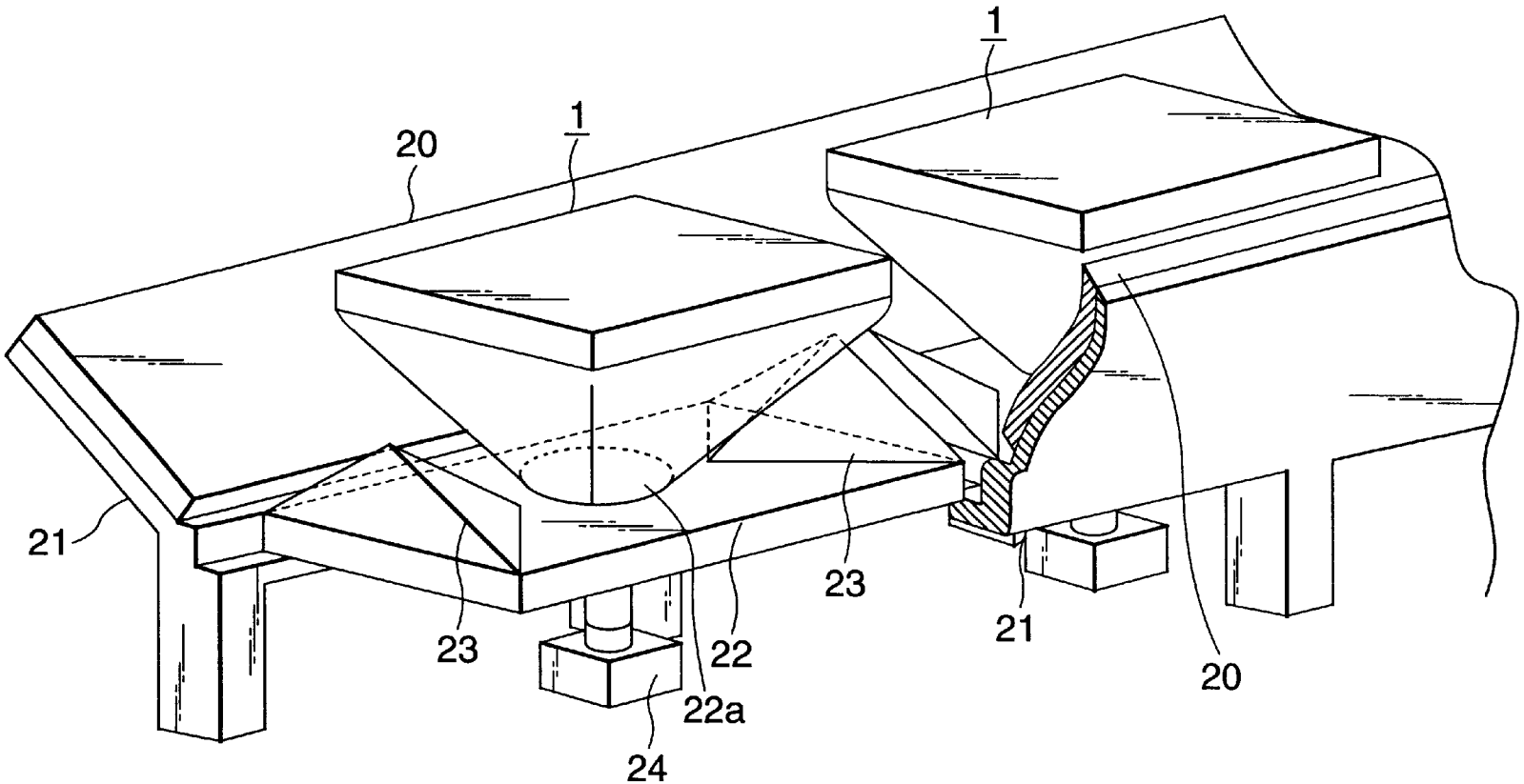
FIG. 5 is a perspective view showing a cathode ray tube manufacturing system according to an embodiment 6 of the present invention.

FIG. 5 shows a cathode ray tube manufacturing system according to an embodiment 6 of the present invention. In FIG. 5, 1 denotes a cathode ray tube; 20, an infrared lamp as an infrared heating means; 21, a supporting table for supporting the infrared lamp 20; 22, a moving board supported by the supporting table 21 to move a production line while fixing the cathode ray tube 1; 22*a*, a cathode ray tube receiving portion provided to the moving board 22 to be fixed to the cathode ray tube 1; 23, an auxiliary mirror surface provided to the moving board 22 to reflect the infrared ray; and 24, a cathode thermal decomposition unit which performs the thermal decomposition process of the cathode of the electron gun.

In this case, the infrared lamps 20 are arranged along a side surface of the funnel portion 3 of the cathode ray tube 1. Upper surfaces of the auxiliary mirror surface 23 are a mirror surface respectively and an edge line thereof forms a triangular pyramid which is parallel with the funnel portion 3. Therefore, the infrared lamps 20 seldom heats a glass casing of the cathode ray tube 1, but they can directly heat the inner coating graphite 10 in the funnel portion 3 of the cathode ray tube 1.

Furthermore, since the funnel portion 3 and the neck portion 4 of the cathode ray tube 1 are partitioned spatially by the moving board 22 and the supporting table 21, the temperature rise of the cathode thermal decomposition unit and the ageing unit can be suppressed when such cathode thermal decomposition unit and such ageing unit are fitted to the neck portion 4 of the cathode ray tube 1.

Therefore, the manufacturing steps can be shortened in contrast to the case where the heating of the inner conductor of the cathode ray tube 1 and the cathode thermal decomposition are carried out by the separate steps, and thus the production efficiency can be improved. Also, it is possible to fit the ageing unit (not shown) to the neck portion 4 in view of the succeeding steps.

In this case, the panel portion 2 of the cathode ray tube 1 is directed upwardly in FIG. 5, but the similar configuration can be employed even if the panel portion 2 is directed in the downward direction or the lateral direction.

Embodiment 7

Figure 6A:
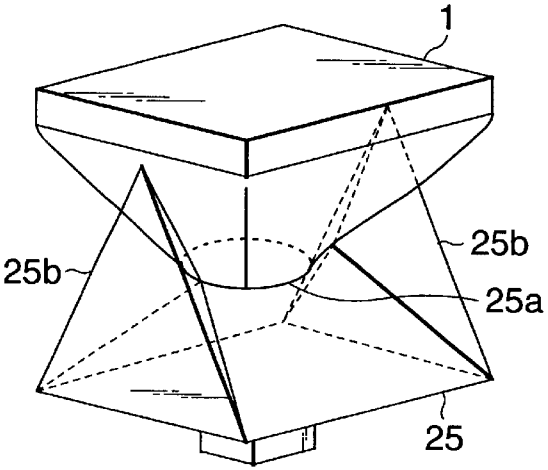
FIG. 6(*a*) is a perspective view showing a cathode ray tube manufacturing method according to an embodiment 7 of the present invention.
Figure 6C:
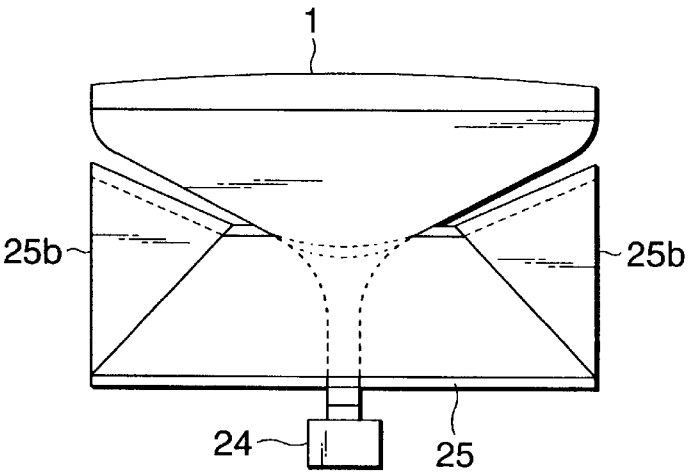
Figure 6B:
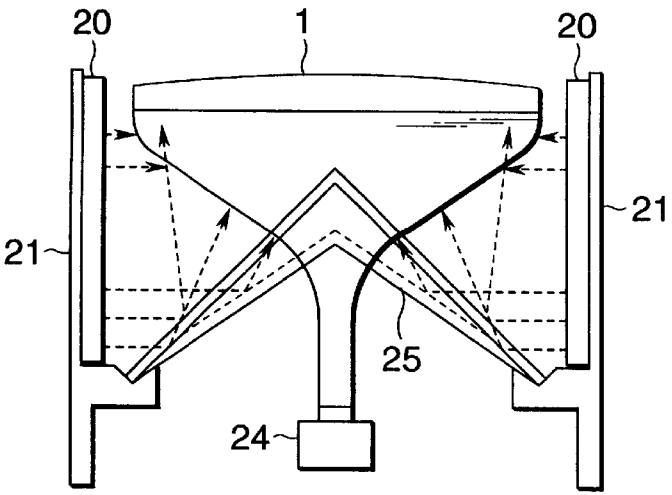

In the embodiment 6, the infrared lamps 20 are arranged along the side surface of the funnel portion 3 of the cathode ray tube 1. However, as shown in FIG. 6, such infrared lamps 20 may be arranged vertically in the embodiment 7. In FIG. 6, 21*a* denotes a supporting table by which the infrared lamps 20 are supported vertically; 25, a moving board which has mirror surfaces to reflect the infrared ray; 25*a*, a cathode ray tube receiving portion for fixing the cathode ray tube 1; and 25*b*, an auxiliary mirror surface provided to the moving board 25 and having one edge line in parallel with the funnel portion.

FIG. 6(*a*) is a perspective view showing the moving board 25 to which the cathode ray tube 1 in the embodiment 6 is fixed. FIG. 6(*b*) is a front view showing the cathode ray tube manufacturing system in the embodiment 6. FIG. 6(*c*) is a side view showing the moving board 25 to which the cathode ray tube 1 in the embodiment 6 is fixed.

The moving board 25 has a side in the same direction as the carrying direction and has an angle for reflecting the infrared ray to the funnel portion 3 on the side surface. The moving board 25 has a hole in which the cathode ray tube 1 is fixed, and is constructed to have triangular surfaces which irradiate the infrared ray uniformly onto the overall inner coating graphite in the cathode ray tube 1, as depicted as arrows indicating the infrared rays in FIG. 6(*b*).

Embodiment 8

Figure 7:
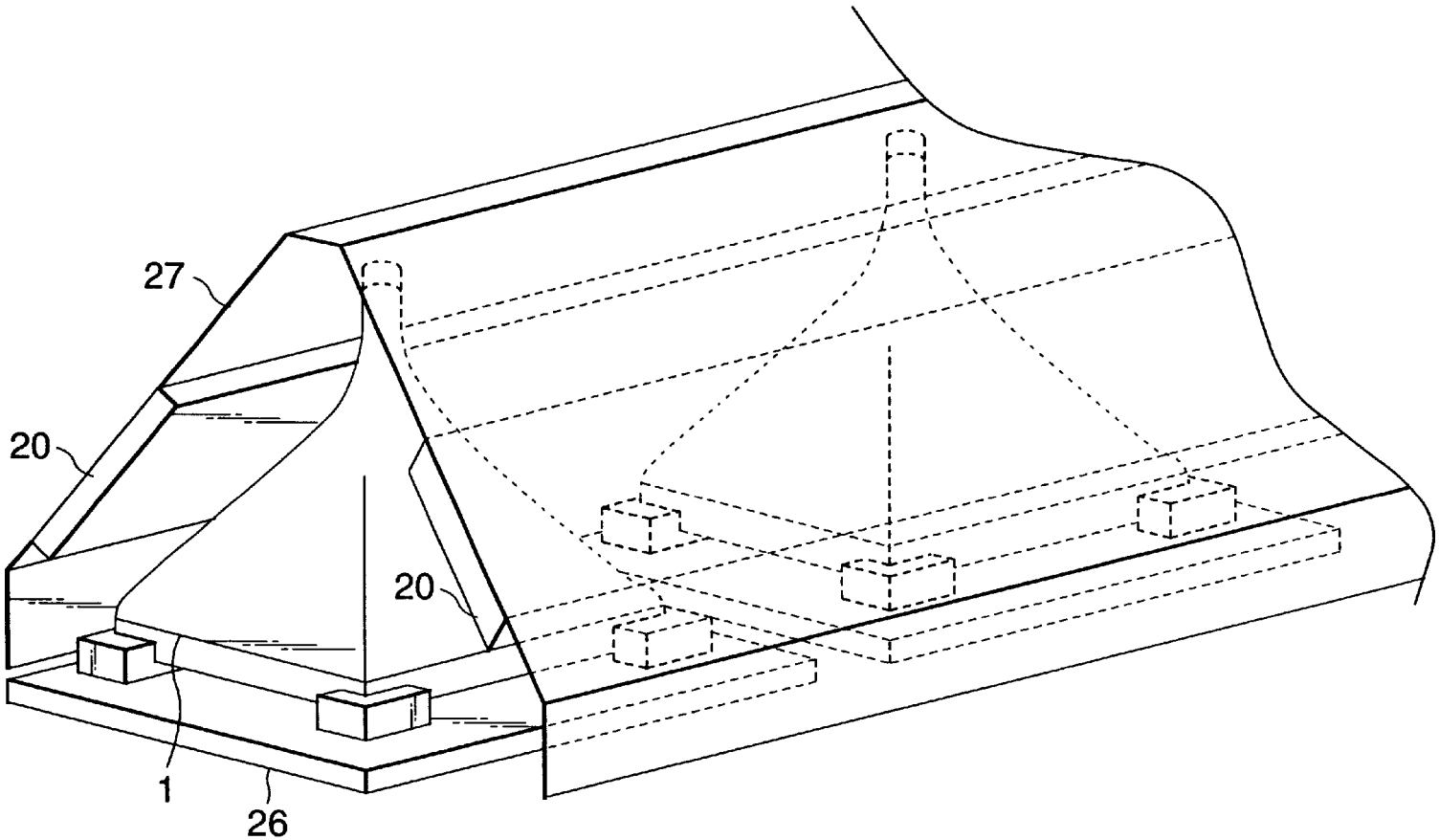
FIG. 7 is a perspective view showing a cathode ray tube manufacturing system according to an embodiment 8 of the present invention.

FIG. 7 shows a cathode ray tube manufacturing system according to an embodiment 8 of the present invention. In FIG. 7, 26 denotes a moving board for receiving the panel portion 2 of the cathode ray tube 1, and 27 denotes a cage for supporting the infrared lamp 20. This cage 27 supports the infrared lamps 20 in parallel with the funnel portion 3, and the cage 27 as well as the moving board 26 is positioned to cover the cathode ray tube 1.

According to the above configuration, a heating efficiency of the cathode ray tube 1 can be improved and the temperature in the cage 27 can be held constantly. As a result, the cathode ray tube 1 can be heated uniformly as a whole, variation in the lifetime characteristic can be reduced, and distortion of material of the cathode ray tube 1 due to the heat is difficult to occur and thus implosions of the cathode ray tube 1 can be reduced. In addition, even if the cathode ray tube 1 cracks, particles of the cathode ray tube 1 can be prevented from vaporing since such cathode ray tube 1 is surrounded with the cage 27.

In this case, an enough effect can be achieved by heating the long side of the cathode ray tube 1 without heating the short side.

Embodiment 9

Figure 8:
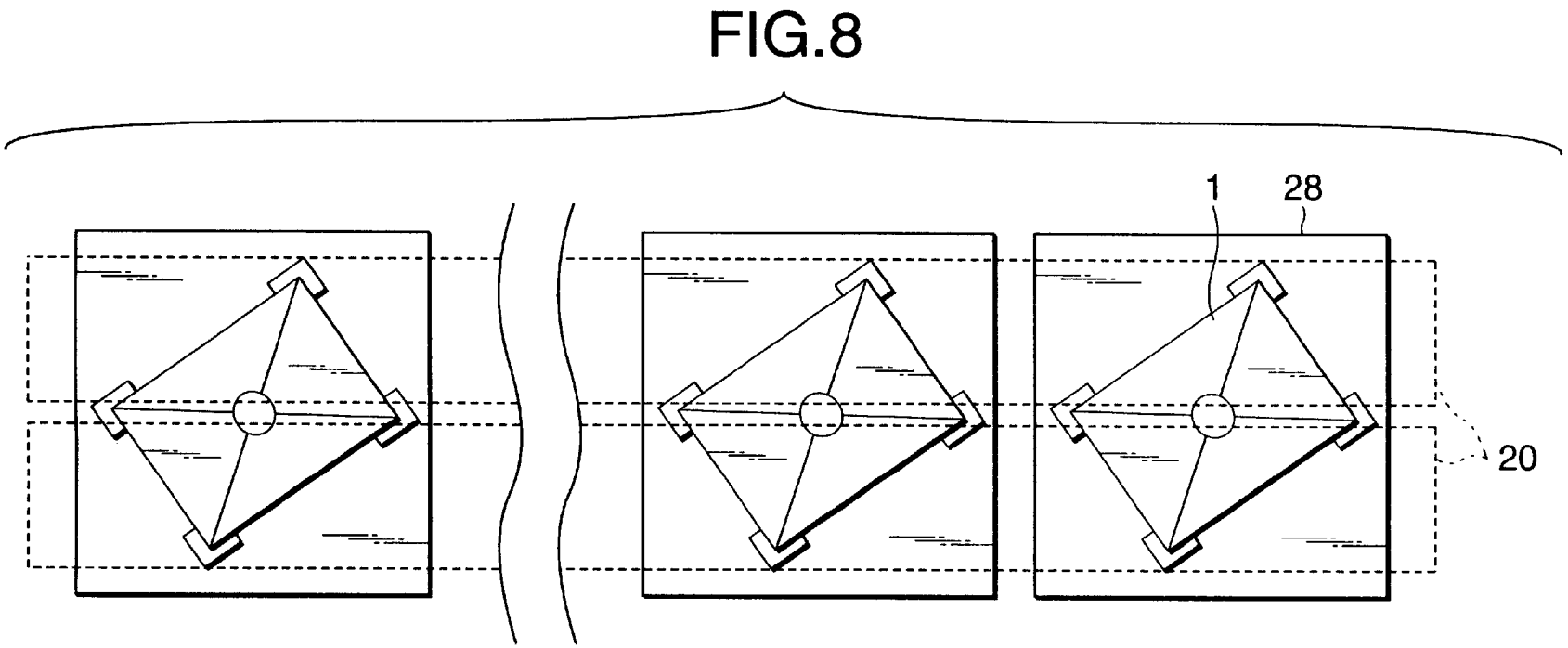
FIG. 8 is a top view showing a cathode ray tube manufacturing system according to an embodiment 9 of the present invention.

FIG. 8 shows a cathode ray tube manufacturing system according to an embodiment 9 of the present invention. In FIG. 8, 28 denotes a moving board which holds diagonal of the funnel portion 3 in the cathode ray tube 1 in the same direction as the carrying direction.

All four surfaces of the funnel portion 3 can directly receive the infrared ray by the moving board 28, so that uniform heating of the inner coating graphite 10 can be attained.

Embodiment 10

Figures 9A, 9B:
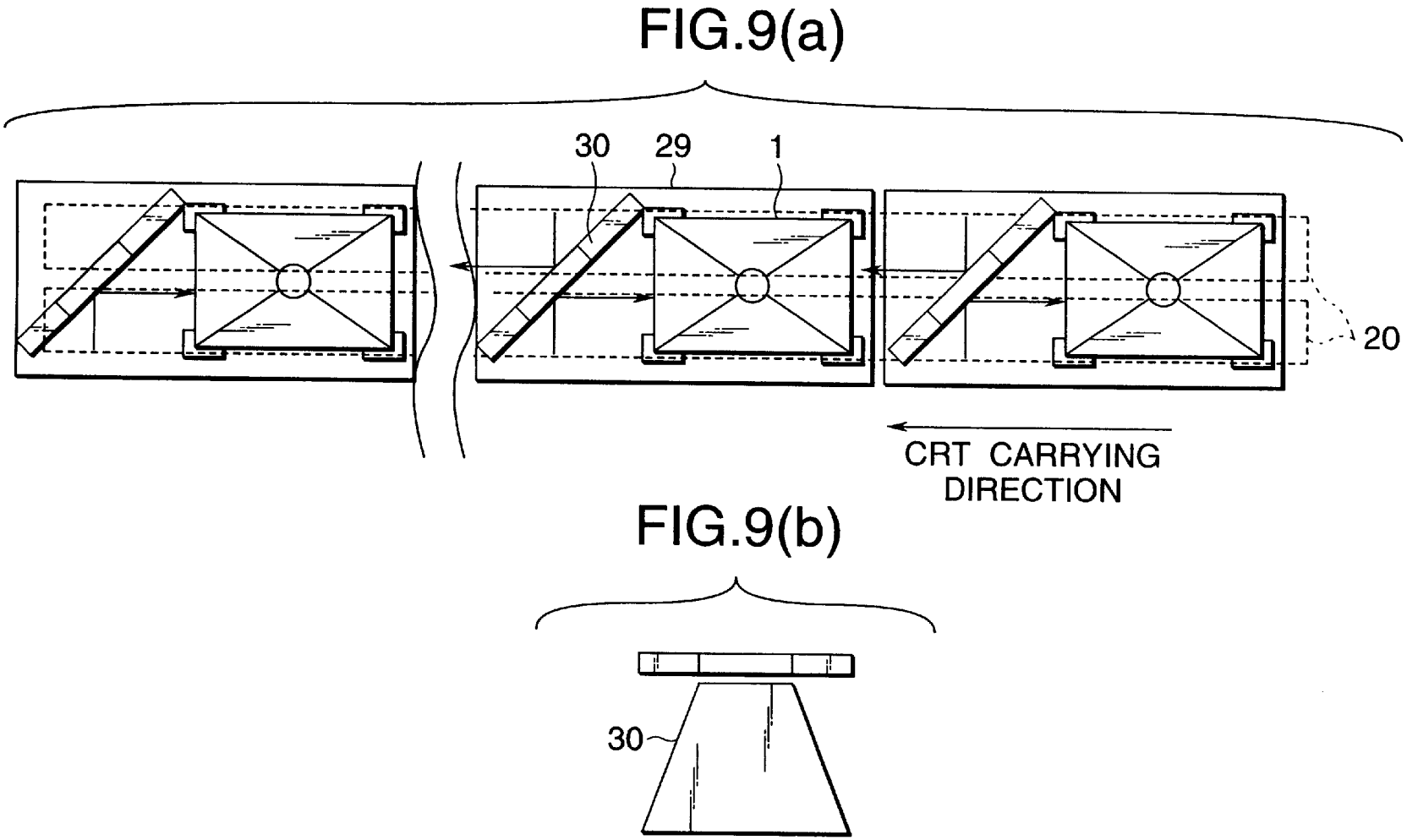
FIG. 9(*a*) is a top view showing a cathode ray tube manufacturing system according to an embodiment 10 of the present invention.

FIG. 9(*a*) shows a cathode ray tube manufacturing system according to an embodiment 10 of the present invention. In FIG. 9(*a*), 29 denotes a moving board for receiving the cathode ray tube 1, and 30 denotes an auxiliary mirror surface whose both surfaces are formed as a mirror surface and which is provided to the moving board 29. FIG. 9(*b*) is a view showing the auxiliary mirror surface which is formed as a trapezoid to mate with the infrared lamp.

When the cathode ray tubes are successively manufactured, the infrared ray can be irradiated onto the surface of the funnel portion 3, which is not parallel with the carrying direction, by providing the auxiliary mirror surfaces 30 along the carrying direction of the moving board 29.

Figure 10A:
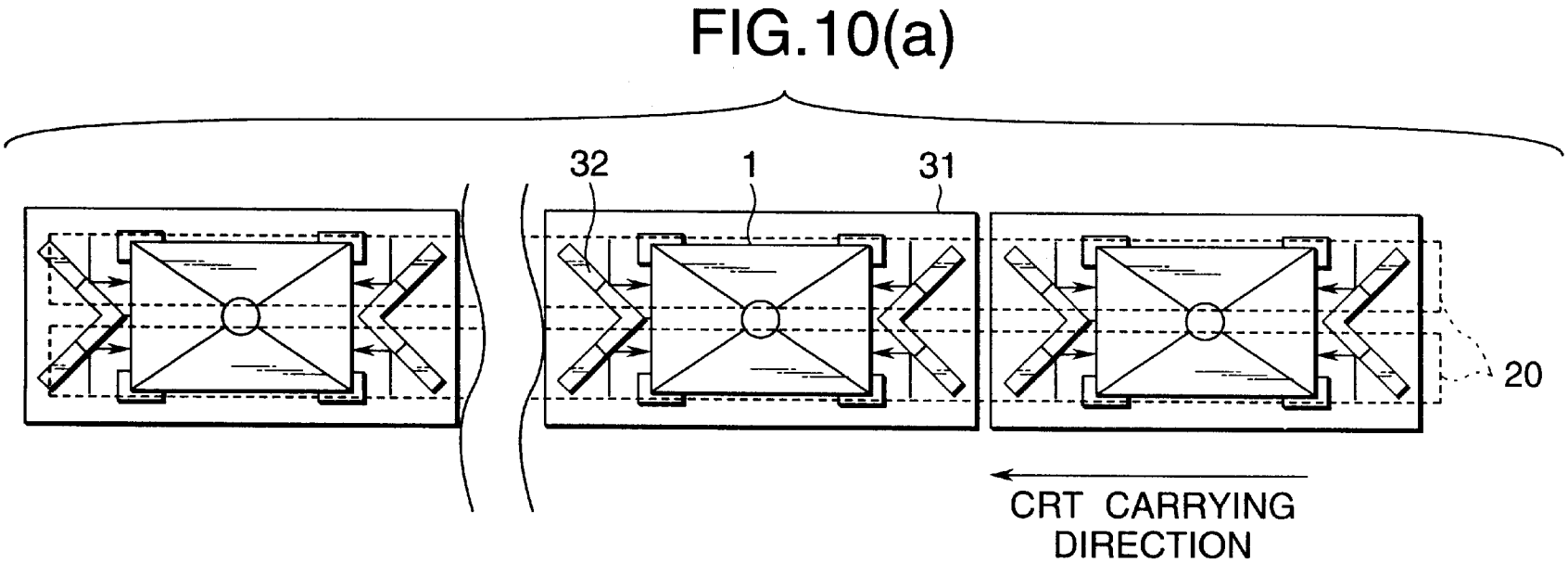
FIG. 10(*a*) is a top view showing a cathode ray tube manufacturing system according to the embodiment 10 of the present invention.
Figure 10B:
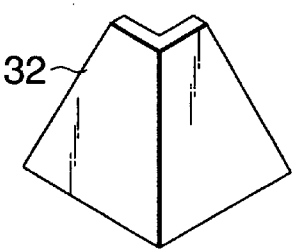
Figure 11:
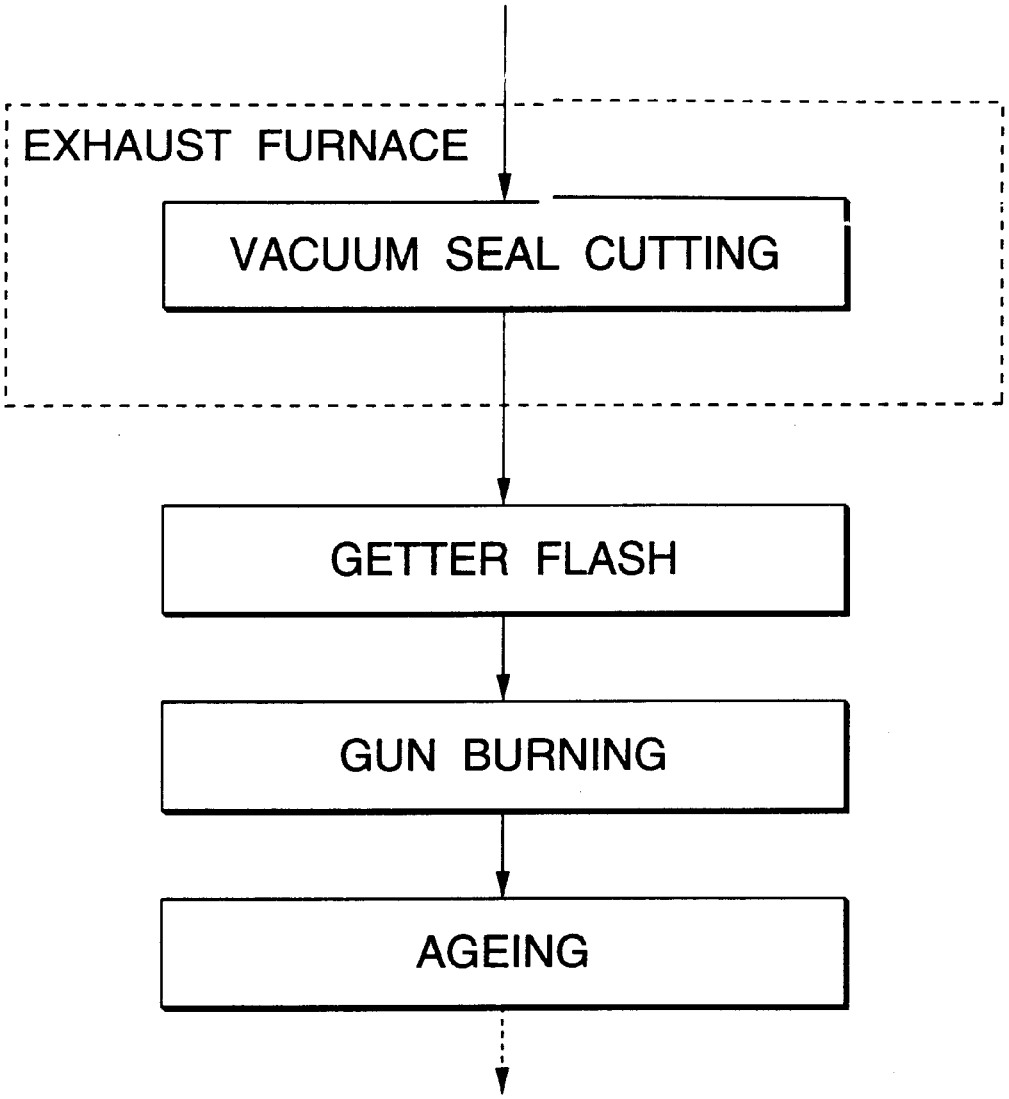
FIG.11 PRIOR ART
FIG. 11 is a chart showing steps of a conventional cathode ray tube manufacturing method.

Also, a similar effect can be achieved by using a cathode ray tube manufacturing system, as shown in FIG. 10(*a*), which is equipped with a moving board 31 having an L-shaped auxiliary mirror surface 32, as shown in FIG. 10(*b*).

According to the present invention, as described above, since the cathode ray tube, especially the funnel portion of the cathode ray tube, is heated after the getter flash, the gas which is physically adsorbed by the constituent portions other than the getter film and the gas which is vapored at the time of getter flash and then physically adsorbed by the constituent portions other than the getter film are outgassed again and then chemically adsorbed by the getter film. Therefore, the gas which is discharged in the ageing step or in operation can be reduced, the damage of the cathode can be reduced, and thus the emission life characteristic of the cathode ray tube can be improved.

Also, since the infrared heating unit is employed as the heating unit, the inner coating graphite serving as the inner conductor in the inside of the funnel portion which can physically adsorb the gas molecular most largely can be directly heated.

In addition, since the cathode thermal decomposition, the arc shield heating/deposition, or the gun heating is performed before the step of heating the inner conductor in the cathode ray tube is completed, the gas being generated in respective processes cannot be adsorbed by the inner conductor but can be adsorbed by the getter film. Thus, the gas being discharged in operation can be reduced, the damage of the cathode can be reduced, and thus the emission life characteristic of the cathode ray tube can be improved. Further, since the gas can be decomposed into $CO_2$ and $H_2O$, which are ready to be adsorbed by the getter film, by heat of the heater of the electron gun, a degree of vacuum in the inside of the above cathode ray tube can be increased much more.

Further, since the infrared heating means are arranged in parallel with the carrying direction of the moving board and at the level higher than the lower end of the moving board along the funnel portion of the cathode ray tube, the inner conductor in the funnel portion can be heated successively and uniformly on the production line.

Furthermore, since the moving board has the hole which fixes the funnel portion and therefore the neck portion of the cathode ray tube is not directly heated, the current can be supplied by connecting the circuit, etc. to the neck portion. In addition, since the auxiliary mirror surface has the edge line along another surface of the funnel portion of the cathode ray tube, surfaces of the funnel portion located in the back and forth direction of the moving board can also be heated uniformly.

Moreover, since both sides of the auxiliary mirror surface are formed as a double-sided mirror positioned along the infrared heating means, surfaces of the funnel portion located in the back and forth direction of the moving board can also be heated uniformly. Also, since the auxiliary mirror surface acts as the partition between the cathode ray tubes on the production line, respective cathode ray tubes are not affected by the implosion.

Besides, since the cage for supporting the infrared heating means to cover the above cathode ray tube is provided, the temperature in the cage can be held constant and thus the cathode ray tube can be heated uniformly. In addition, variation in the emission life characteristic of the cathode ray tube can be reduced, and distortion of the cathode ray tube due to the heat is difficult to occur and thus cracks of the cathode ray tube can be reduced. In addition, even if the cathode ray tube cracks, particle of the cathode ray tube can be prevented from vaporing since such cathode ray tube is surrounded with the cage.

Since the moving board can move the cathode ray tube while fixing the cathode ray tube to coincide one edge line of the funnel portion of the cathode ray tube with the carrying direction, the infrared heating unit can irradiate directly all surfaces of the funnel portion and thus can heat uniformly the cathode ray tube.

What is claimed is:

1. A cathode ray tube manufacturing method comprising:

an exhaust step of removing an air and a residual gas in an inside of a cathode ray tube;

a getter flash step of removing the residual gas;

a heating step for heating a funnel portion of the cathode ray tube; and an activating step for activating the cathode ray tube.

2. The cathode ray tube manufacturing method according to claim 1, wherein, in the heating step of heating the funnel portion, an inner conductor in an inside of the funnel portion is directly heated by an infrared heating unit.

3. The cathode ray tube manufacturing method according to claim 2, wherein at least one of cathode thermal decomposing process, arc shield heating/deposition, and gun burning is executed before the heating step of heating the inner conductor is completed.

4. A cathode ray tube manufacturing system comprising:

a moving board for moving a cathode ray tube in parallel with a set of surfaces of a funnel portion of the cathode ray tube while fixing the cathode ray tube;

infrared heating means arranged in parallel with a carrying direction of the moving board and at a level higher than a lower end of the moving board along the funnel portion of the cathode ray tube; and a supporting table for supporting the moving board and the infrared heating means, wherein the moving board has an auxiliary mirror surface which reflects an infrared ray to the funnel portion in a carrying direction side.

5. The cathode ray tube manufacturing system according to claim 4, wherein the moving board has a hole which fixes the funnel portion and the auxiliary mirror surface which has an edge line along another surface of the funnel portion of the cathode ray tube.

6. The cathode ray tube manufacturing system according to claim 4, wherein both sides of the auxiliary mirror surface are formed as a double-sided mirror along the infrared heating means.

7. A cathode ray tube manufacturing system comprising:

a moving board for moving a cathode ray tube while fixing the cathode ray tube;

infrared heating means arranged in parallel with a carrying direction of the moving board along a funnel portion; and a cage for supporting the infrared heating means to cover the cathode ray tube.

8. The cathode ray tube manufacturing system according to claim 7, wherein the moving board moves the cathode ray tube while fixing the cathode ray tube to coincide one edge line of the funnel portion of the cathode ray tube with a carrying direction.

* * * * *